US010001135B2

(12) United States Patent
Pellenc et al.

(10) Patent No.: US 10,001,135 B2
(45) Date of Patent: Jun. 19, 2018

(54) PROPELLER OF A PULSED AIRFLOW GENERATOR, IN PARTICULAR FOR A PORTABLE BLOWER

(75) Inventors: Roger Pellenc, Pertuis (FR); Philippe Gilbert, Le Puy Sainte Reparade (FR)

(73) Assignee: PELLENC (SOCIETE ANONYME), Pertuis (FR)

( * ) Notice: Subject to any disclaimer, the term of this patent is extended or adjusted under 35 U.S.C. 154(b) by 781 days.

(21) Appl. No.: 14/110,691

(22) PCT Filed: Apr. 5, 2012

(86) PCT No.: PCT/FR2012/000128
§ 371 (c)(1),
(2), (4) Date: Dec. 20, 2013

(87) PCT Pub. No.: WO2012/140336
PCT Pub. Date: Oct. 18, 2012

(65) Prior Publication Data

US 2014/0105749 A1 Apr. 17, 2014

(30) Foreign Application Priority Data

Apr. 11, 2011 (FR) ..... 11 01102

(51) Int. Cl.
*F04D 29/32* (2006.01)
*F04D 29/02* (2006.01)
(Continued)

(52) U.S. Cl.
CPC ..... *F04D 29/329* (2013.01); *F04D 29/023* (2013.01); *F04D 29/34* (2013.01);
(Continued)

(58) Field of Classification Search
CPC ..... F04D 29/285; F04D 29/329; F04D 29/34
See application file for complete search history.

(56) References Cited

U.S. PATENT DOCUMENTS 2,960,939 A * 11/1960 Buschhorn ..... F04D 29/20 403/230
3,285,187 A * 11/1966 Anderson, Jr. ..... F04D 29/2222 29/889.4
(Continued)

FOREIGN PATENT DOCUMENTS

DE 102007055614 * 5/2009 ..... F04D 29/285

*Primary Examiner* — Kenneth Bomberg
*Assistant Examiner* — Cameron Corday
(74) *Attorney, Agent, or Firm* — Egbert Law Offices, PLLC

(57) ABSTRACT

A propeller of a pulsed airflow generator, in particular for a standalone portable blower, of the type made up of the assembly of two parts coaxially adjoining one another, i.e.: a first front part made as a single piece and comprising a plurality of twisted blades connected to a central ring, and a second rear part with a generally conical shape also made as a single piece, the central portion of said assembly having a conical shape and making up the rear portion of an air-inlet cone, said propeller being characterised in that said first and second rear parts are secured by a clamping device made up of a hub including two parts assembled coaxially and between which said two parts that make up the propeller are clamped, said hub being rotatably secured to the latter and maintaining said front and rear parts in the assembled position thereof.

11 Claims, 6 Drawing Sheets

(51) Int. Cl.
*F04D 29/34* (2006.01)
*F04D 29/38* (2006.01)
*F04D 29/64* (2006.01)

(52) U.S. Cl.
CPC ..... *F04D 29/384* (2013.01); *F04D 29/388* (2013.01); *F04D 29/64* (2013.01); *F04D 29/646* (2013.01); *F05D 2230/23* (2013.01); *F05D 2300/12* (2013.01); *F05D 2300/43* (2013.01)

(56) References Cited

U.S. PATENT DOCUMENTS

| | | | | |
|---|---|---|---|---|
| 4,183,719 | A * | 1/1980 | Bozung | F01D 5/045 415/143 |
| 6,290,467 | B1 * | 9/2001 | Dewhirst | F01D 5/025 416/244 R |
| 8,690,552 | B2 * | 4/2014 | Chang | F04D 17/16 415/205 |
| 8,727,729 | B2 * | 5/2014 | Noronha | B23P 15/006 416/186 R |
| 8,985,970 | B2 * | 3/2015 | Spaggiari | F04D 29/263 417/423.1 |
| 2008/0022481 | A1 * | 1/2008 | Reeves | A01G 1/125 15/330 |
| 2010/0074761 | A1 * | 3/2010 | Yang | F04D 29/626 416/244 R |
| 2010/0215508 | A1 * | 8/2010 | Hagshenas | F04D 29/285 416/90 R |

* cited by examiner

Fig. 8
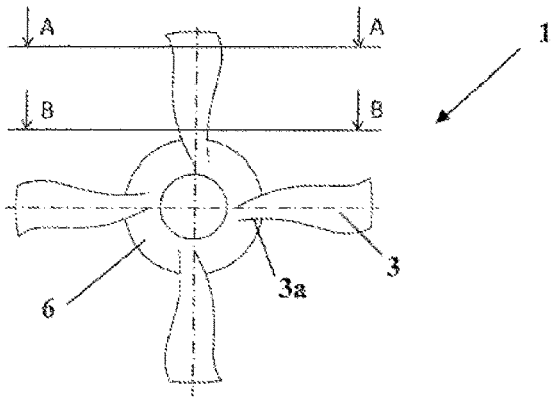
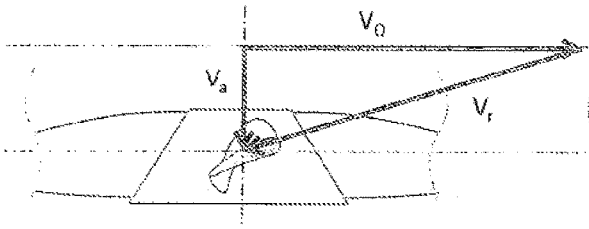
Section A-A
Fig. 8A
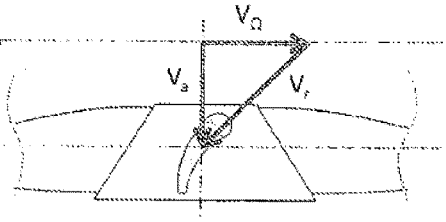
Section B-B
Fig. 8B

PROPELLER OF A PULSED AIRFLOW GENERATOR, IN PARTICULAR FOR A PORTABLE BLOWER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN SUBMITTED ON COMPACT DISC

Not applicable.

BACKGROUND OF THE INVENTION

1. Field of the Invention

The present invention concerns a propeller of a pulsed airflow generator, in particular for a portable blower. It is of more particular interest that it is applicable to portable electric blowers. Such devices are commonly used to "sweep" dry leaves or various debris from various surfaces such as lawns, city streets, outside parking areas, sports grounds, play grounds, etc.

The invention also applies to portable devices, in particular to self-powered blowers featuring a pulsed air generator making use of this method and this propeller.

2. Description of Related Art Including Information Disclosed Under 37 CFR 1.97 and 37 CFR 1.98

Axial fans used in the manufacture of blowing machines comprise a propeller consisting of a number of radial, straight or twisted blades that are attached at their base to a central hub.

Blowing machines using propellers with straight blades have the disadvantage of weak performance, so that it is often preferred to use propellers with twisted blades which perform better.

In fact, the profile of each blade acts somewhat like the wings on an aircraft. It presents, at the air inlet, a leading edge and, at the air outlet, a trailing edge. For optimal performance the air must arrive at the leading edge in an essentially perpendicular manner. On the other hand, in order to achieve optimal operation of the fan, in application of the principle of the velocity triangle (FIGS. 8, 8A, 8B), one seeks to create, through the rotation of the fan, an airflow at speed Va that is as uniform as possible over the entire surface of the fan and thus to obtain a speed Va. Now, if we consider the profile of a blade root, it rotates around the axis of the fan, essentially at a speed VΩ equal to the speed of rotation multiplied by the radius of the blade root where this profile is positioned. This profile thus receives the air at a relative speed Vr. If one considers the profile positioned at the end of the blade, it also generates an air speed Va through the rotation of the propeller, but it turns at the same rotational speed multiplied by the radius of its position relative to the axis of the fan which is considerably greater than the radius at the blade root. This results in a relative airspeed Vr that is much greater but has an orientation that is further away from the axis of the fan than at the blade root. This principle explains the fact that a high-performing propeller should be constituted by twisted blades which does not make its manufacture any easier.

Therefore, one tends to position the beginning of the blades as far away as possible from the axis of rotation in order to reduce the differential of orientation of the speed Vr between the blade root and the blade top, thereby simplifying the manufacture of the blades somewhat. But on that account it becomes necessary to integrate in front of the propeller a cone for improving the aerodynamics of the air inlet. It is clear that the length of this air inlet cone is proportional to the radius of the blade root, the length of said cone increasing with the radius of said blade root. The fans needing this type of cone have therefore greater space requirements which is a definite disadvantage for those applications where high performance is sought for portable devices with a pulsed air generator of reduced volume.

When blowers of large dimensions need to be built where the blades are fastened on the central hub, either through welding or through mechanical fasteners, their construction does not create big problems.

On the other hand, when one wants to apply such propellers to the production of axial fans of smaller size, such as those in axial fans producing the pulsed airflow in sweeper and/or cleaning blowers for which this invention is more specifically intended, molding such small-size propellers becomes practically impossible, unless injection equipment or methods are applied which require the use of very complex molds (loose-detailed molds). This results in higher costs for tooling and, consequently, of the manufactured products, and also leads to fragility of the mold and thus a reduction of its useful life which means an additional increase in the cost of the parts. Most of the time, a propeller of this type cannot be molded with existing methods and equipment, and the designer is therefore inclined to make a compromise on the geometry of the propeller so that it can be produced by molding.

Besides, the parts produced by such equipment and methods may lack precision and show major variations from one lot to the next.

It has been thought to remedy these disadvantages by proposing axial propellers where the blades are attached to a cylindrical hub or with blades with reduced twist, or with a reduced number of blades, to the detriment of the performance of the propellers produced this way.

Document US-2010/007476.1 describes a pusher-type airscrew constituted by the assembly of two parts coaxially attached one after another, like this: a first front part consisting of a single block and constituted by a number of twisted blades attached to a central ring, a second rear part, of a general conical shape also consisting of a single block. The two parts are assembled by engaging the root of the blades of the propeller into slots provided on the second rear part. The central part of this assembly presents the shape of a truncated, cone, the vertex of which consists of a flat, relatively large area which interferes with the aerodynamics of the air inlet.

Document U.S. Pat. No. 4,462,757 discloses a propeller of a cooling fan also consisting of two parts that are coaxially attached one after another, like this: a first front part formed by a single block and consisting of a number of twisted blades attached to a central ring, a second rear part of a general conical shape, also formed by a single block. The two parts are assembled with screws. The central part of this assembly presents the shape of a truncated cone the vertex of which also consists of a flat, relatively large area disturbing the aerodynamics of the air inlet.

Document DE-28 55 909 also describes a propeller for a cooling fan of an internal combustion engine, constituted by the assembly of two parts coaxially attached one after another, like this: a first front part formed of a single block and constituted by a number of twisted blades attached to a central ring, a second rear part of a general conical shape also consisting of a single block. According to this document, the first and second parts are also assembled by a number of screws. The central part of this assembly presents the shape of a truncated cone the vertex of which is also constituted by a flat, relatively large area disturbing the aerodynamics of the air inlet.

One aim of the present invention is to propose a propeller without the afore-mentioned disadvantages.

BRIEF SUMMARY OF THE INVENTION

According to the invention, this aim is achieved by a propeller of a pulsed airflow generator, particularly for portable blowers, of the type consisting of the assembly of two parts coaxially attached one after another, like this:

- a first front part formed of a single block and consisting of a number of twisted blades attached to a central ring,
- and a second rear part of a generally conical shape also formed of a single block, the central part of this assembly presenting a conical shape and constituting, the rear part of an air inlet cone, this propeller being remarkable in that said first front and second rear part are united by means of a clamping device constituted by a hub comprising two coaxially assembled parts, preferably by fitting one into the other and between which are clamped said two constitutive parts of the propeller, said hub being integral in rotation with the latter and ensuring that said front and rear parts remain in the position of assembly.

According to an advantageous method of implementation, the front part of the clamping device presents a conical shape and constitutes the vertex of the air inlet cone.

According to an advantageous method of implementation, the locking of the two hub parts in the clamping position is obtained by forced fitting of the rear part of said hub into the front part of the latter.

According to a preferred implementation, the hub features an axial bore to accommodate the seating of the end of the drive motor shaft, the shaft end being made integral with the front part of the hub by forced fitting.

According to an advantageous implementation, the front and rear parts are assembled by embedding and the twisted blades are attached to the central ring through the intermediary of spaced blade roots, and the rear part features a number of spaced teeth or claws engaged in the gaps provided between said blade roots.

The device according to the invention is also remarkable in that the outer surface of the blade roots and the outer surface of the teeth or claws constitute portions of the surface of the air inlet cone, the junction lines of these outer surfaces being virtually imperceptible, so that the assembly of these surfaces presents the aspect of a continuous, cone-shaped surface.

The invention also aims at a portable blower featuring an axial fan, characterized in that the propeller of this axial fan comprises at least one of the afore-mentioned. major characteristics.

The device according to the invention provides several interesting advantages. Notably:

- to achieve the embodiment of complex propeller geometry using a simple manufacturing process;
- this process allows good repeatability of the quality of the constitutive parts of the propeller;
- obtaining parts that require no balancing as they come out of the mold;
- limited cost for tooling and a low cost price of the produced propellers;
- the obtainment of propellers of small dimensions with optimized performance.

BRIEF DESCRIPTION OF THE DRAWINGS

The above aims, characteristics and advantages, as well as still more, will become clearer from the following detailed description and the attached drawings in which:

FIGS. 8, 8A, and 8B illustrate an application of the principle of the triangle of speeds.

FIG. 8 is a schematic plan view of a propeller with twisted blades.

FIG. 8A is a section view along line A-A of FIG. 8.

FIG. 8B is a section view along line B-B of FIG. 8.

Figure 1:
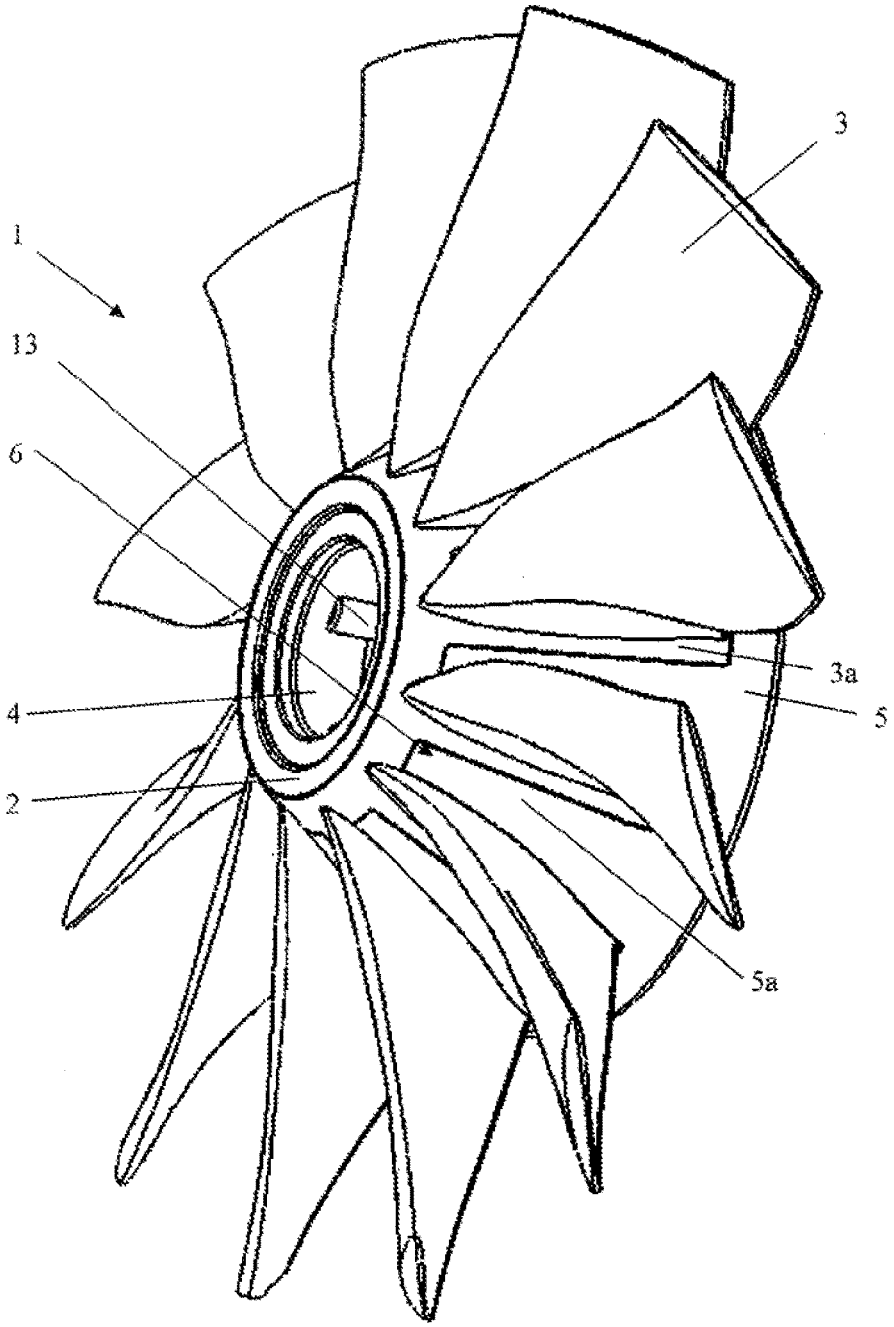
FIG. 1 is a perspective view of an example of an axial propeller produced according to the invention.
Figure 2:
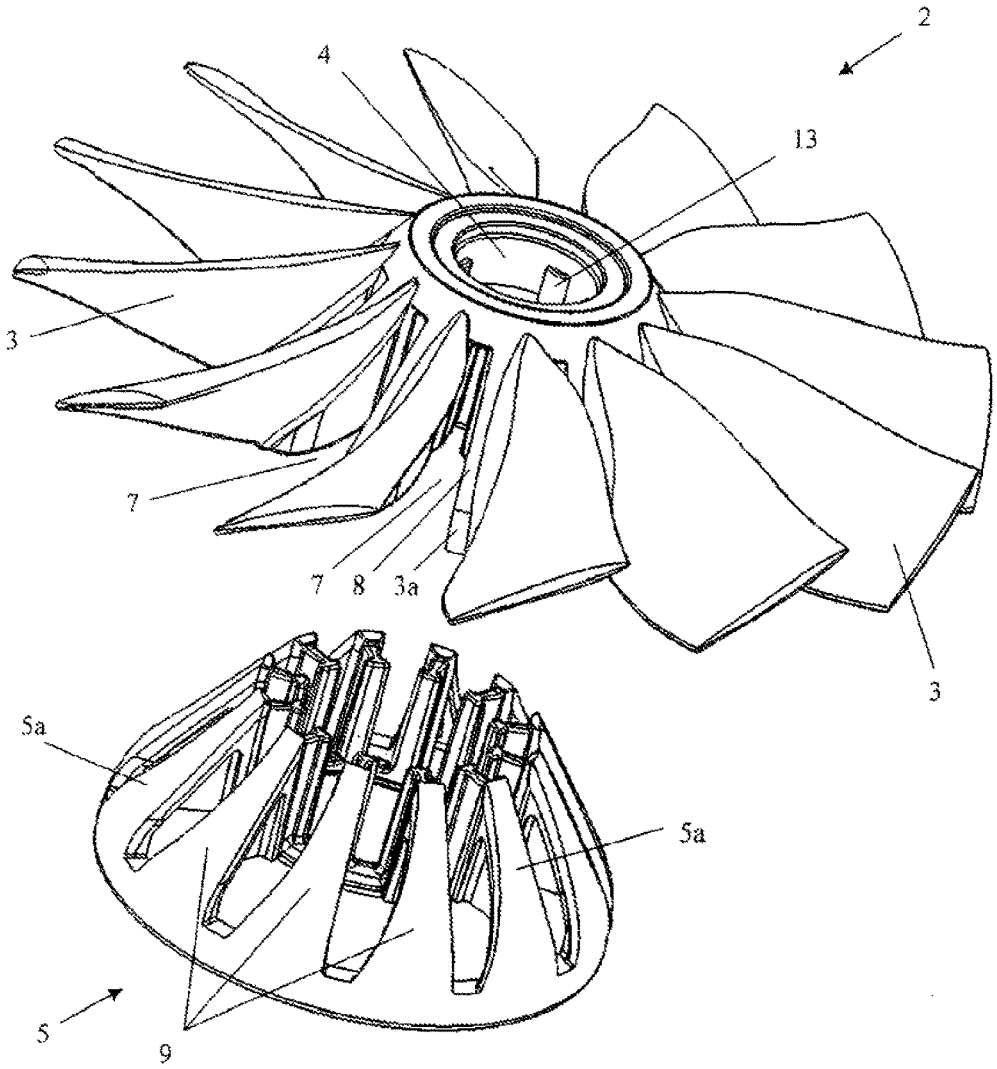
FIG. 2 is an exploded view of the two constitutive parts of the propeller the assembly hub of which is not shown.
Figure 3:
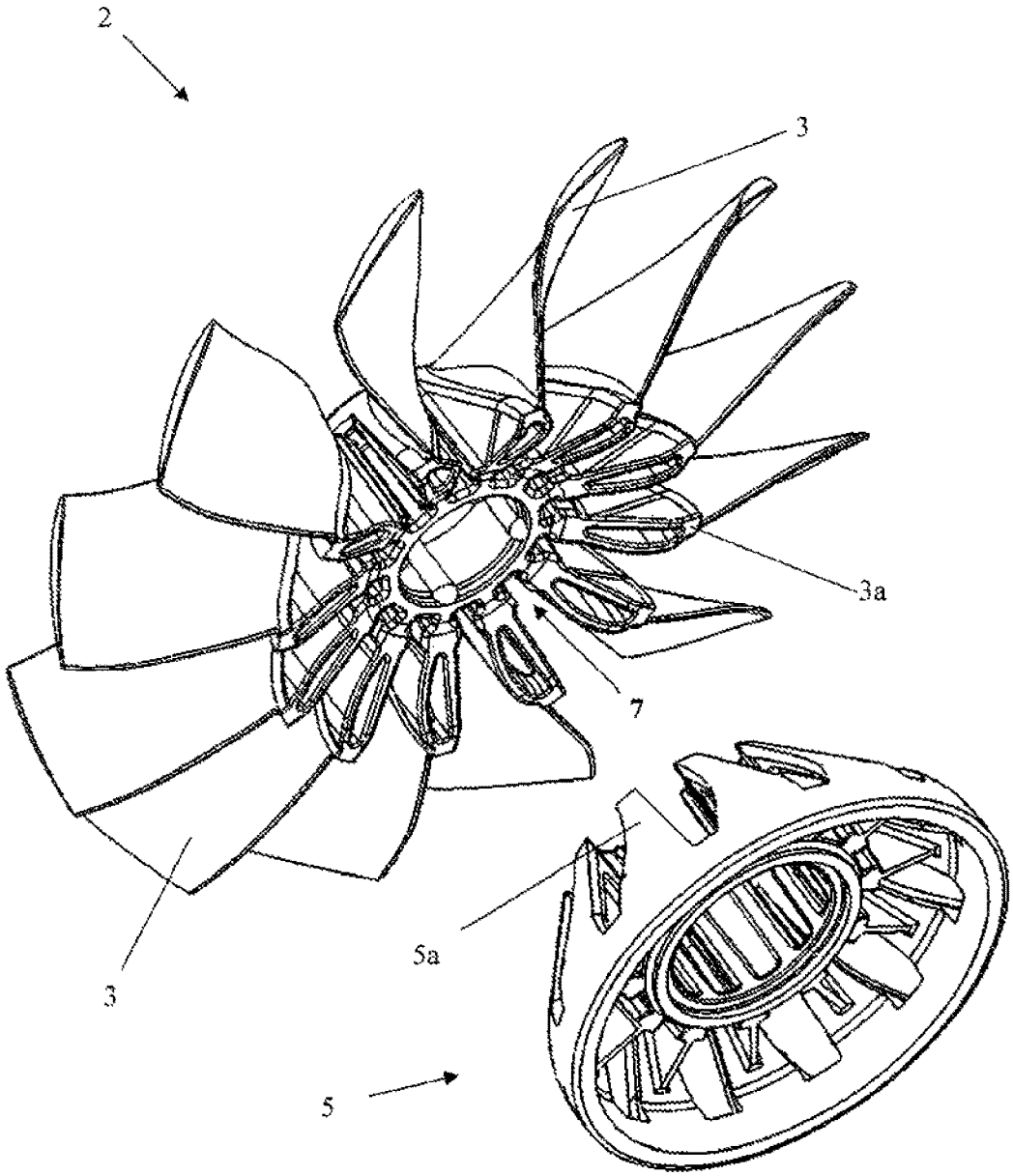
FIG. 3 is also a perspective view of the two constitutive parts of the propeller seen from another angle.

Reference is made to these drawings to describe an interesting, although by no means limiting example, of embodiment of the propeller according to the invention.

DETAILED DESCRIPTION OF THE INVENTION

The axial high-performance propeller 1 according to the invention is constituted by the assembly of two parts coaxially attached one after another, like this:

- a first front part 2 formed of a single block and constituted by a number of twisted blades 3 attached to a central ring 4,
- and a second rear part 5 of a general conical shape also formed by a single block, the central part 6 of this assembly presenting a continuous conical shape or more exactly the form of a truncated cone constituting the rear part of an air inlet cone.

Advantageously, the front part 2 and the rear part 5, are assembled by rigidly fitting them together.

According to an interesting implementation, the twisted blades 3 are attached to the central ring 4 through the intermediary of spaced blade roots 3*a* and the rear part 5 features a number of spaced teeth or claws 5*a* engaged in the gaps 7 provided between said blade roots 3*a*.

The claws 5*a* of the rear part present a straight edge oriented along a generating line of the air inlet cone or oriented obliquely in relation to this generating line, and an opposite curved edge the shape of which corresponds to the surface of the blade roots this curbed edge comes into contact with. This complementary shaping of the claws 5*a* and the blade roots 3*a* ensures good assembly by fitting together the front part 2 and the rear part 5.

The blade roots 3*a* to which the base of blades 3 is attached present, laterally, a surface that overlaps one of the sides of said base. The outer surface 8 of the overlapping part of the blade roots 3*a* and the outer surface 9 of the teeth or claws 5*a* constitute portions of the surface of the air inlet cone 6.

Preferably, the front part 2 and the rear part 5 are obtained by molding, using any suitable equipment or process, for instance by an injection process that is known per se.

Advantageously the front piece 2 and the rear piece 5 are made of plastic or light metal, presenting the desirable rigidity for their function.

Figure 4:
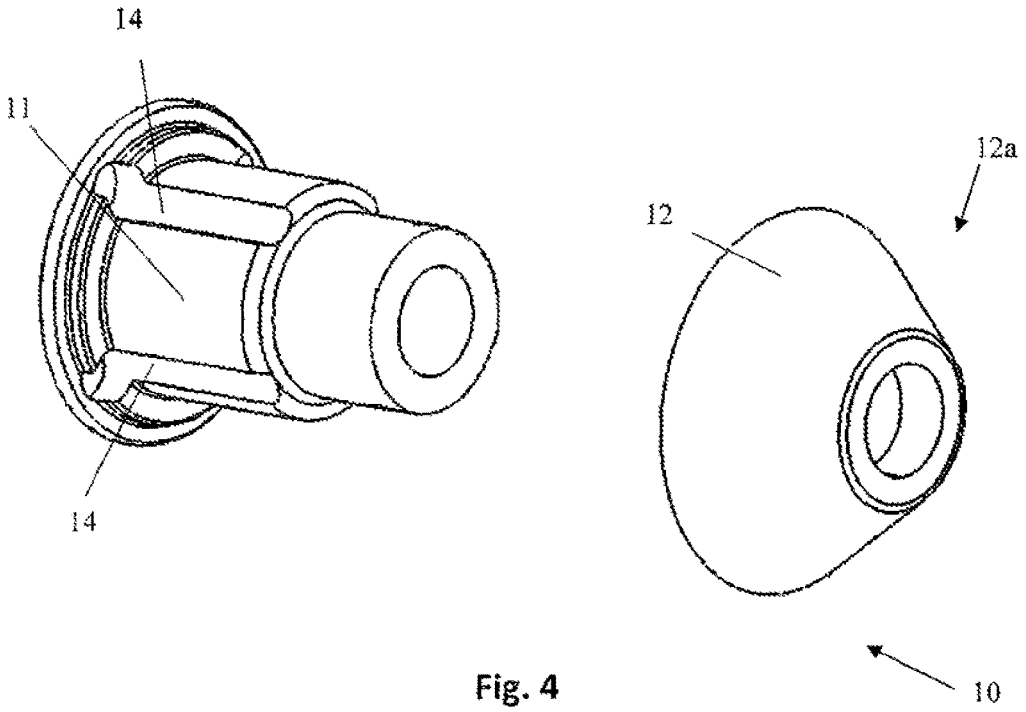
FIG. 4 is an exploded view of the assembly hub.
Figure 5:
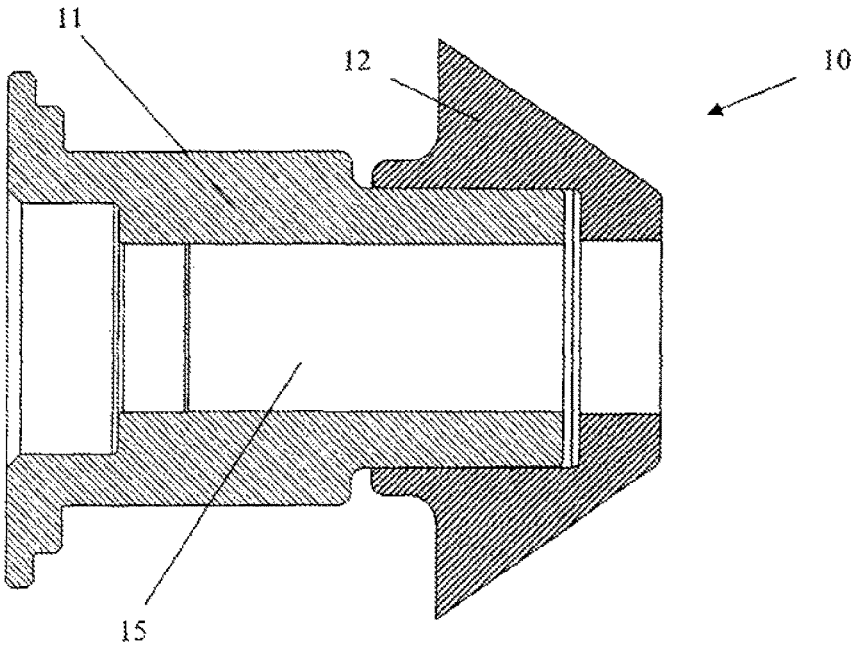
FIG. 5 is an axial section of this hub shown in assembled position.
Figure 6:
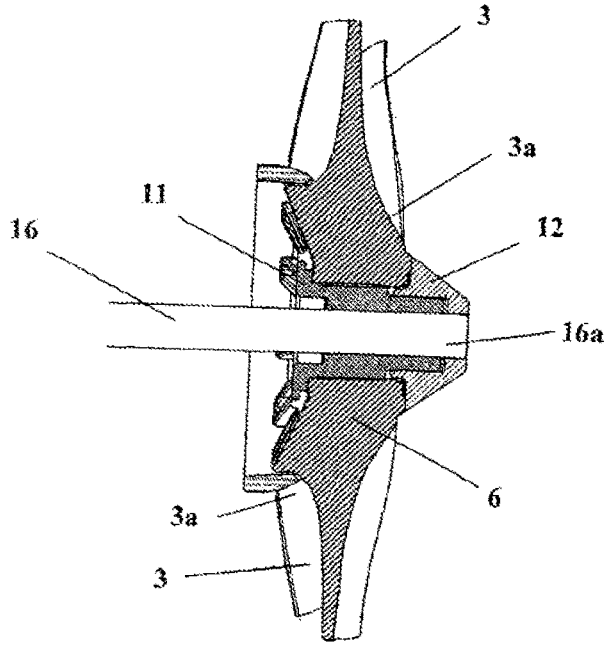
FIG. 6 is a partial axial section showing the two constitutive parts assembled by the hub and of the drive shaft.
Figure 7:
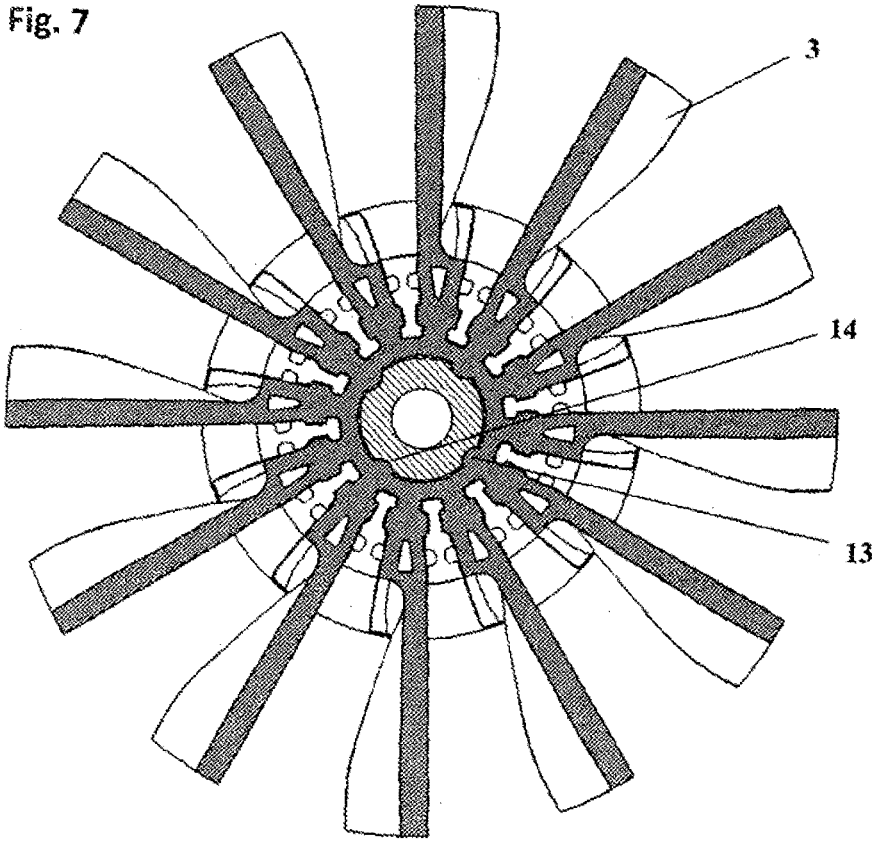
FIG. 7 is a cross section of the central part of the propeller and shows the drive mechanism in rotation.

According to the invention, maintenance of the front piece 2 and the rear piece 5 in the assembled position is achieved, by a clamping device 10 (FIGS. 4 and 5) constituted by a hub comprising two pieces 11 and 12 that are coaxially assembled and between which the two fitted parts 2, 5 constitutive parts of propeller 1, are clamped.

The hub 10 is integral in rotation with the propeller 1. For example, the inner cylindrical surface of the central ring 4 presents, for this purpose, angularly spaced ribs 13 that are oriented in parallel to its axis, whereas the outer cylindrical surface of the rear piece 10 of hub 9 features angularly spaced grooves 14 into which the ribs 13 are engaged.

According to the illustrated example, the front piece 12 of the clamping hub 10 presents a front portion 12*a* of conical shape positioned in front of the cone 6 and constituting with the latter an air inlet cone 6-12*a*. Said. front portion 12*a* constitutes the vertex of this air inlet cone.

Locking of the two pieces 11, 12 of the clamping hub 10 in the clamping position is preferably obtained by a forced fitting of the rear piece 11 of said hub 10 into the front piece 12 of the latter.

The hub 10 features an axial bore 15 for seating the end 16*a* of the shaft of a drive motor 16, the shaft end being made integral with the front piece 12 of the hub 10 through forced fitting.

It is clear that the shaft 116 is thereby integral in rotation with the hub 10 which is itself integral in rotation with the actual propeller 1.

The portable blower according to the invention is of the type that includes an axial fan.

According to the invention, this blower is remarkable in that the axial fan presents the major characteristic arrangements described above, or that it results from the implementation of the process according to the invention.

The invention claimed is:

1. A propeller assembly for a pulsed airflow generator, the propeller assembly comprising:

a propeller having:

a front piece formed by a single block and having a number of twisted blades attached to a central ring; and a rear piece formed by another single block and having a generally conical shape, said rear piece being rigidly and coaxially attached to said front piece, said front piece said rear piece forming a central part having a conical shape and defining a rear portion of an air inlet cone;

a clamping device having:

a hub having a pair of coaxially assembled pieces, said hub having an axial bore adapted to seat a shaft or a drive motor therein;

wherein said front piece and said rear piece are clamped between the pair of coaxially assembled pieces so as to assure that said front piece and said rear piece remain in an assembled position, said hub being integral in rotation with said front piece and said rear piece.

2. The propeller assembly of claim 1, wherein a front piece of said pair of coaxially assembled pieces has a conical shape and defines a vertex of said air inlet cone.

3. The propeller assembly of claim 1, wherein said pair of coaxially assembled pieces are fitted together.

4. The propeller assembly of claim 3, wherein said pair of coaxially assembled pieces are forced fitted together.

5. The propeller assembly of claim 1, said number of twisted blades being attached to said central ring through respective blade roots, said rear piece having a plurality of spaced claws respectively engaged in gaps between adjacent blade roots.

6. The propeller assembly of claim 5, the blade roots having a surface which overlaps on one side of the blade with an outer surface of an overlapping part of the blade roots, said claws having an outer surface that constitutes portions of said air inlet cone.

7. The propeller assembly of claim 1, said front piece and said rear piece being molded.

8. The propeller assembly of claim 1, said front piece and said rear piece being formed of a rigid plastic material.

9. The propeller assembly of claim 1, said front piece and said rear piece being formed of a metallic material.

10. A portable blower comprising:

the propeller assembly of claim 1, and said shaft or drive motor.

11. The portable blower of claim 10, including both said shaft and said drive motor, said drive motor having said shaft , said shaft having an end that is force fitted to a front piece of said pair of coaxially assembled pieces, said hub having an axial bore seated on said end of said shaft.

* * * * *